US008162774B2

(12) United States Patent
Sato et al.

(10) Patent No.: US 8,162,774 B2
(45) Date of Patent: Apr. 24, 2012

(54) GOLF CLUB, HEAD OF GOLF CLUB AND METHOD FOR ADJUSTING PROPERTY OF GOLF CLUB

(75) Inventors: Fumiaki Sato, Chichibu (JP); Hiroshi Takahashi, Chichibu (JP); Hideo Matsunaga, Chichibu (JP)

(73) Assignee: Bridgestone Sports, Co. Ltd., Tokyo (JP)

( * ) Notice: Subject to any disclaimer, the term of this patent is extended or adjusted under 35 U.S.C. 154(b) by 254 days.

(21) Appl. No.: 12/645,667

(22) Filed: Dec. 23, 2009

(65) Prior Publication Data

US 2010/0323808 A1 Dec. 23, 2010

(30) Foreign Application Priority Data

Jun. 23, 2009 (JP) ..... 2009-148807

(51) Int. Cl.
*A63B 53/02* (2006.01)

(52) U.S. Cl. ..... 473/307; 473/246; 473/309; 473/288

(58) Field of Classification Search ..... 473/288, 473/307, 309, 310, 244–248
See application file for complete search history.

(56) References Cited

U.S. PATENT DOCUMENTS

| | | | | |
|---|---|---|---|---|
| 7,819,754 | B2 * | 10/2010 | Evans et al. | 473/307 |
| 7,883,430 | B2 * | 2/2011 | Thomas et al. | 473/307 |
| 2007/0265106 | A1 * | 11/2007 | Burrows | 473/307 |
| 2010/0144459 | A1 * | 6/2010 | Sato et al. | 473/303 |
| 2010/0160069 | A1 * | 6/2010 | Burrows | 473/307 |
| 2010/0255927 | A1 * | 10/2010 | Evans | 473/307 |
| 2011/0092308 | A1 * | 4/2011 | Thomas et al. | 473/307 |
| 2011/0105241 | A1 * | 5/2011 | Thomas et al. | 473/307 |

FOREIGN PATENT DOCUMENTS

| | | | |
|---|---|---|---|
| JP | 11-178954 | A | 7/1999 |
| JP | 2000-005349 | A | 1/2000 |
| JP | 2003-070940 | A | 3/2003 |

* cited by examiner

*Primary Examiner* — Stephen L. Blau
(74) *Attorney, Agent, or Firm* — Sughrue Mion, PLLC

(57) ABSTRACT

A golf club includes: a head, formed with a hosel insertion hole, including: a female screw, formed in an inner peripheral surface of the entrance portion of the hosel insertion hole; a hosel, formed with a shaft case insertion hole and mounted on a deep portion of the hosel insertion hole; a shaft case, formed with a shaft insertion hole, a leading end portion of the shaft case being mounted into the shaft case insertion hole; a ring holder, fitted with an outer surface of the shaft case; a screw member, fitted with an outer surface of the ring holder in a peripheral direction of the ring holder; and a male screw, formed on an outer peripheral surface of the screw member so that the screw member is engaged with the female screw; and a shaft, inserted into the shaft insertion hole of the head.

13 Claims, 9 Drawing Sheets

GOLF CLUB, HEAD OF GOLF CLUB AND METHOD FOR ADJUSTING PROPERTY OF GOLF CLUB

BACKGROUND

1. Field of the Invention

The present invention relates to a golf club and, specifically, the invention relates to a golf club and a head of such golf club the properties of which, such as the lie angle, slice angle and goose can be adjusted easily. Also, the invention relates to a method for adjusting the properties of such golf club.

2. Description of the Related Art

A golf club is structured such that a head is mounted on the leading end portion of a shaft, while a grip is mounted on the base end portion of the shaft.

Referring to the structure of a conventional ordinary golf club head, a hosel hole is formed directly in the head, while the shaft is inserted into the hosel hole and is fixed thereto using an adhesive agent. Here, as the adhesive agent, there is generally used an epoxy-system adhesive agent. To replace the shaft, the hosel portion of the head may be heated to destroy the structure thereof formed of hardened epoxy resin by the adhesive agent, whereby the shaft can be then pulled out of the hosel portion of the head.

In JP-A-11-178954, there is disclosed a golf club head structured such that a head main body and a hosel are formed separately from each other and the hosel is fixed to the head main body using a screw. In JP-A-11-178954, a plate-shaped neck portion is formed on the lower end side of the hosel, and the neck portion is inserted into the insertion portion of the head main body and fixed thereto using a screw. Thus, since the plate-shaped neck portion is fixed to the head main body in this manner, in the impact time when the head hits a ball, the neck portion is allowed to bend, thereby relieving the concentration of stresses occurring in the connecting portion between the shaft and hosel.

In the golf club head disclosed in JP-A-11-178954, the lie angle, slice angle and the like thereof cannot be adjusted. Also, since the connecting strength between the head main body and hosel as well as their rigidity are insufficient, the golf club head cannot provide a strong impact feeling. Also, the position of the hosel is excessively high.

SUMMARY

The invention aims at solving the problems found in the above-mentioned conventional golf club head. Thus, it is an object of the invention to provide a golf club and a head of such golf club the properties of which, such as the lie angle, slice angle and goose can be adjusted, as well as a method for adjusting such properties.

According to a first aspect of the invention, there is provided a golf club head, formed with a hosel insertion hole for mounting a leading end of a shaft, the golf club head including: a female screw, formed in an inner peripheral surface of the entrance portion of the hosel insertion hole; a hosel, formed with a shaft case insertion hole and mounted removably on a deep portion of the hosel insertion hole; a shaft case, formed with a shaft insertion hole, a leading end portion of the shaft case being removably mounted into the shaft case insertion hole; a ring holder, fitted with an outer surface of the shaft case and unmovable in an axial direction thereof; a screw member, fitted with an outer surface of the ring holder rotatably in a peripheral direction of the ring holder and unmovable in an axial direction thereof; and a male screw, formed on an outer peripheral surface of the screw member so that the screw member is threadedly engaged with the female screw.

According to a second aspect of the invention, there is provided a golf club, including: a head, formed with a hosel insertion hole, including: a female screw, formed in an inner peripheral surface of the entrance portion of the hosel insertion hole; a hosel, formed with a shaft case insertion hole and mounted removably on a deep portion of the hosel insertion hole; a shaft case, formed with a shaft insertion hole, a leading end portion of the shaft case being removably mounted into the shaft case insertion hole; a ring holder, fitted with an outer surface of the shaft case and unmovable in an axial direction thereof; a screw member, fitted with an outer surface of the ring holder rotatably in a peripheral direction of the ring holder and unmovable in an axial direction thereof; and a male screw, formed on an outer peripheral surface of the screw member so that the screw member is threadedly engaged with the female screw; and a shaft, inserted into the shaft insertion hole of the head.

The shaft may be concentric with the shaft case insertion hole.

The shaft may be concentric with the hosel insertion hole.

An axis of the shaft may be inclined with respect to an axis of the hosel insertion hole.

An axis of the shaft may be parallel to an axis of the hosel insertion hole and may be separated from the axis of the hosel insertion hole.

The shaft may be fixed to the shaft insertion hole with an adhesive agent.

A lower end portion of the hosel may have a polygonal-shaped section, and the deep portion of the hosel insertion hole may have a section adapted to engage with the lower end portion of the hosel.

The above golf club may include an elastic member, interposed between the lower end portion of the hosel and an inner surface of the deep portion of the hosel insertion hole.

An axis of the shaft may be inclined with respect to an axis of the hosel, and the axis of the shaft may intersect with the axis of the hosel at an inside of the hosel.

An axis of the shaft may be inclined with respect to an axis of the hosel, and the axis of the shaft may intersect with the axis of the hosel at an aperture plane of the hosel.

According to a third aspect of the invention, there is provided a method for adjusting a property of the golf club according to the second aspect, including: separating the hosel from the hosel insertion hole and shaft case; replacing the hosel and the ring holder with other hosel and ring holder structured such that the position or angle of the shaft case insertion hole is different; and fixing the shaft case to the hosel insertion hole by the screw member.

According to a fourth aspect of the invention, there is provided a method for adjusting a property of the golf club according to the second aspect, including: fixing a new shaft to a new shaft case to form a connected unit; removing the shaft case and the shaft from the head; and mounting the connected unit onto the head.

In a golf club and a head of such golf club according to the invention, the hosel is removably mounted into the deep portion of the hosel insertion hole, and the leading end of the shaft case is removably engaged with the shaft case insertion hole of the hosel. On the shaft case, there is mounted the ring holder. On the ring holder, there is mounted the screw member. When the screw member is mounted into and removed from the male screw of the entrance portion of the hosel insertion hole, the shaft case can be fixed to and can be pulled out from the hosel mounting hole. Therefore, by replacing the old hosel and ring holder with other hosel and ring holder which are different in the lie angle, slice angle or goose thereof from the old hosel and ring holder, or by changing the peripheral direction phase of the hosel, the shaft case with a shaft connected thereto can be mounted again onto the head main body.

For example, by replacing the old hosel and ring holder with a hosel and a ring holder in which the axis of a shaft is set in a direction oblique to the axis of the hosel insertion hole (for example, in an obliquely crossing direction), the mounting direction of the shaft on the head main body can be changed, whereby the lie angle and slice angle can be changed.

Therefore, in a golf club including the same shaft and the same head main body, only the lie angle or slice angle can be adjusted.

Also, by replacing an old hosel and an old ring holder with a new hosel and a new ring holder in which the position of the shaft case insertion hole is shifted from the axial position of the hosel insertion hole in a parallel translation manner, in a golf club including the same shaft and the same head main body, the goose and the distance between the shaft and the center of gravity (gravity distance) of the golf club can be adjusted.

Here, according to the invention, the hosel and ring holder are not replaced but the shaft with a shaft case connected thereto may be replaced, thereby being able to replace the shaft. That is, as a shaft case, there is previously prepared entirely the same type of shaft case, a shaft having different properties is previously fixed to this prepared shaft case, an old head shaft case/shaft connected unit is replaced with this shaft case/shaft connected unit is replaced, and this new shaft case/shaft connected unit is mounted onto the hosel of the head. In this manner, there can be obtained a golf club in which only the shaft is different.

According to this shaft replacing method, it is possible to omit a conventional troublesome labor and time requiring operation in which the adhesive agent is heated to destroy the structure of the adhesive agent, the old shaft is removed from the head main body, and a new shaft is then mounted again onto the head main body. Thus, a shaft case/shaft connected unit can be removed from the head of a golf club just after it is used for a ball hitting try, another new shaft case/shaft connected unit having different properties can be mounted onto the same head immediately for another try. This makes it very easy for a golfer to find out a proper golf club in a golf shop and the like. Also, the evaluation of the shaft can be carried out regardless of the difference between individual heads.

Recently, in order for a golfer to be able to find a golf club proper for the skill level of the golfer, there has been developed a system by which the golfer can find a golf club proper for the golfer using a computer, a high speed camera and the like. In this system, individual commercial golf clubs are used for a trial and are compared with each other according to the head speeds and ball hitting angles of the golf clubs to thereby be able to find a proper one.

On the other hand, according to a golf club of the invention, only the position relationship between the same shaft and head is changed to thereby change the gravity distance and progression, whereby a golfer can easily realize the difference in the flying property (the hitting angle and spin) of the ball hit out between the respective changed positions of the same shaft and head easily. Also, by replacing only the shaft for the same head, the golfer can realize the difference between only the shafts. Also, according to the physical condition of a golf player on the day of play, the golf player can replace the shaft; and, while the same shaft is used but, in order to adjust the lie angle, slice angle and goose, the golf player can change the mounting direction of the shaft onto the head.

Here, when the lower end portion of the hosel and the deep portion of the hosel insertion hole are respectively formed to have a polygonal section, the positioning (phase determination) of the hosel in the peripheral direction thereof can be carried out. Also, rotation between the head and hosel can be prevented.

When an elastic member is interposed between the lower end of the hosel and the inner surface of the deep portion of the hosel insertion hole, there can be absorbed impacts and vibrations which are caused between the hosel insertion hole and hosel.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
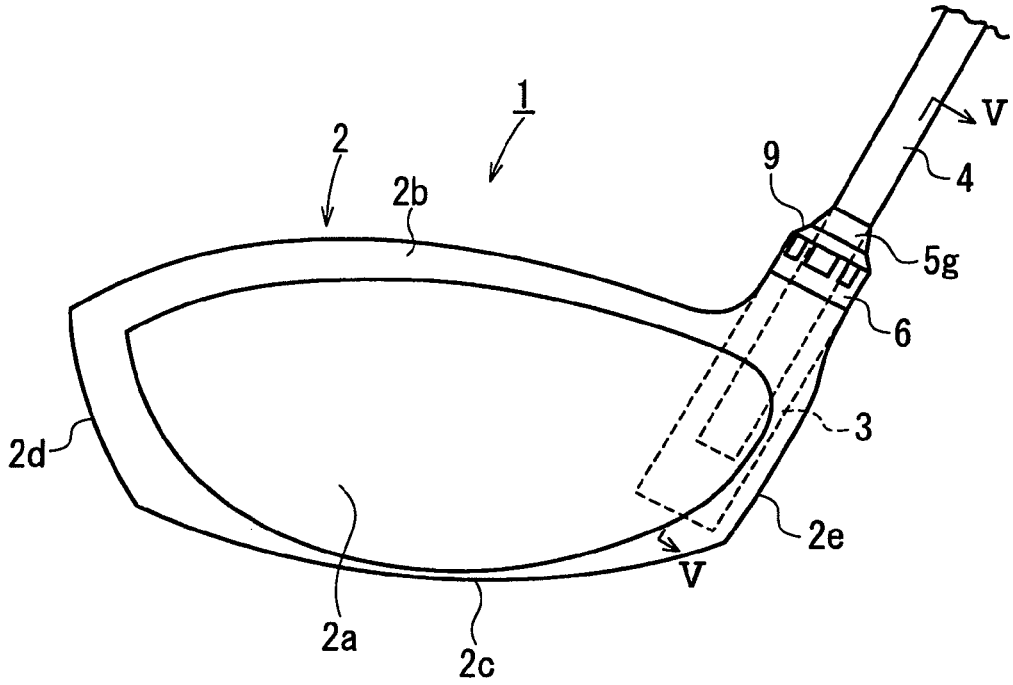
FIG. 1 is a front view of a golf club head according to an embodiment of the invention.
Figure 2:
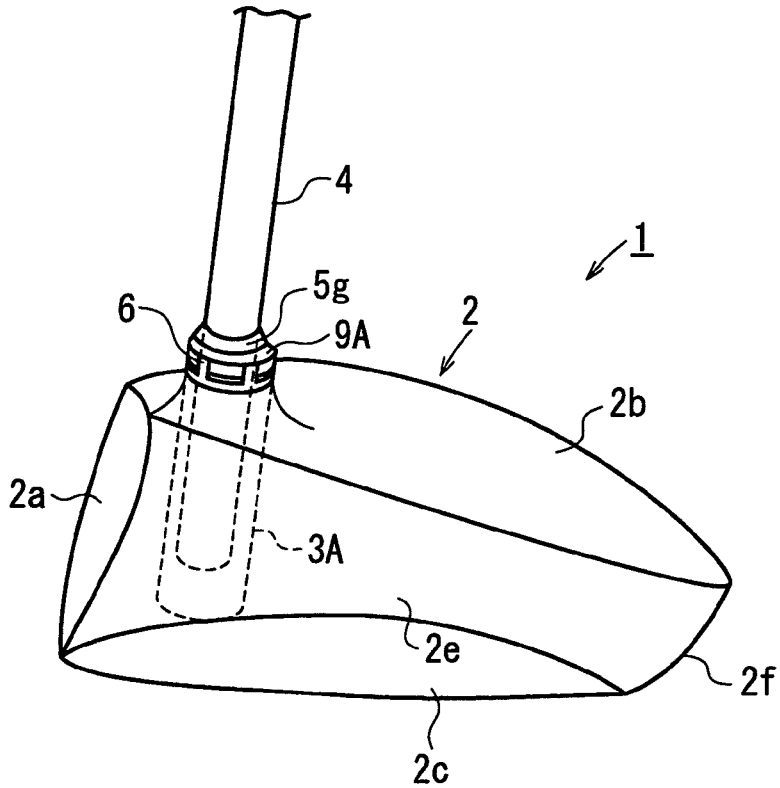
FIG. 2 is a side view of the golf club head in which the axis of a shaft is set eccentric to the axis of a hosel.
Figure 3:
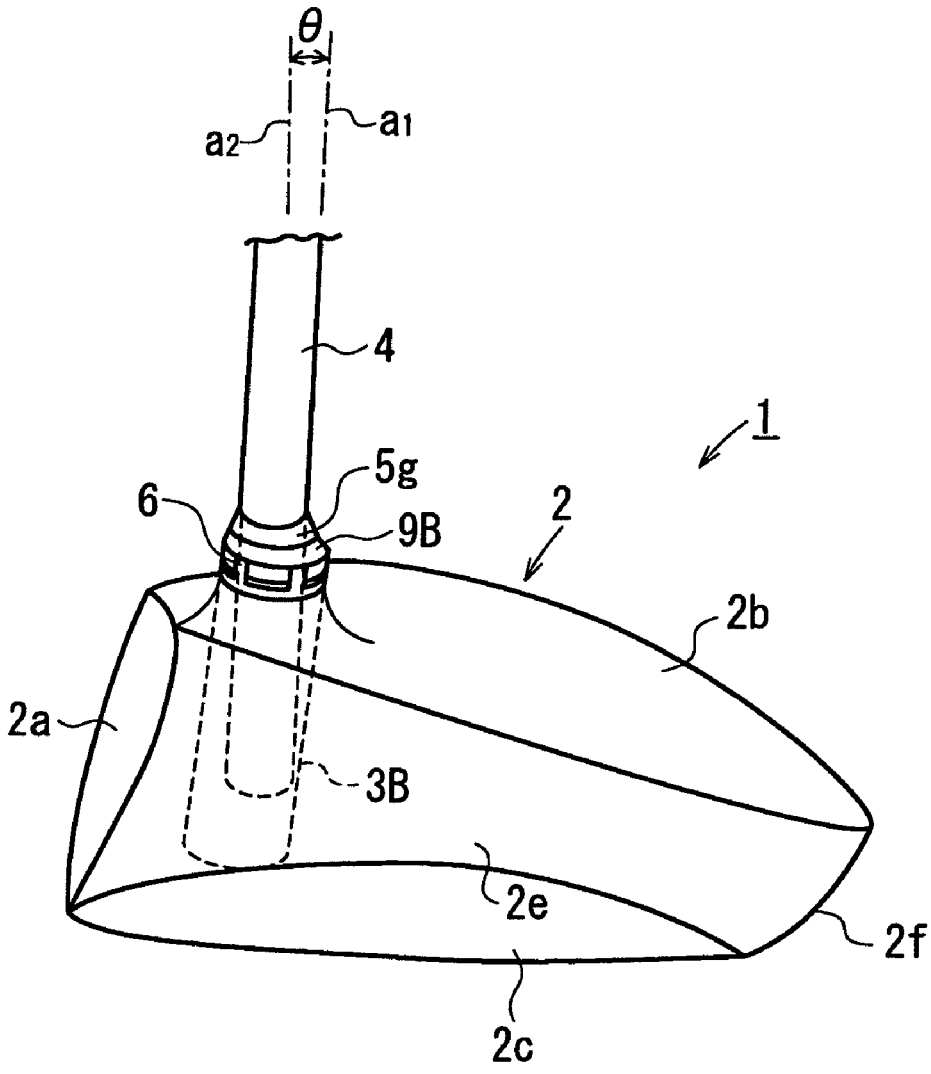
FIG. 3 is a side view of the golf club head in which the inclining direction of the shaft is changed.
Figure 4A:
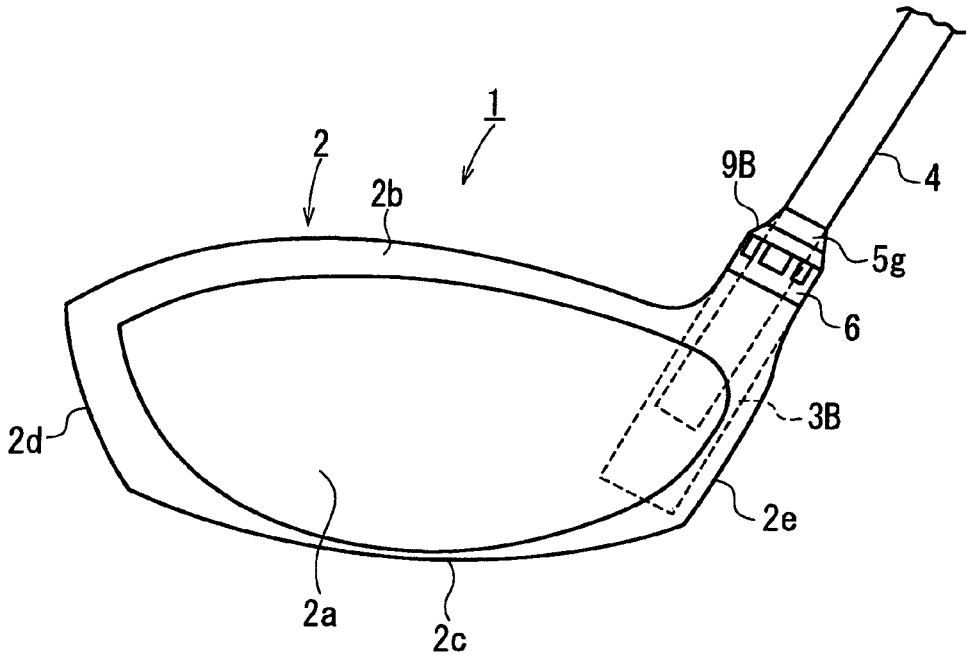
FIGS. 4A and 4B are front views of the head in which the inclining direction of the shaft is changed.
Figure 4B:
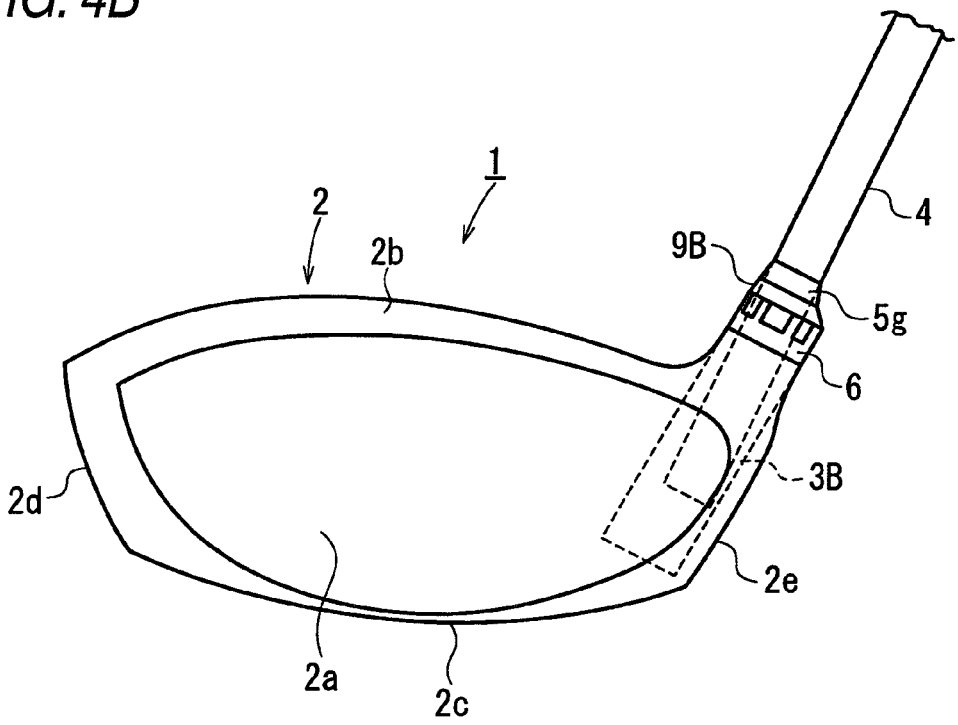
Figure 5:
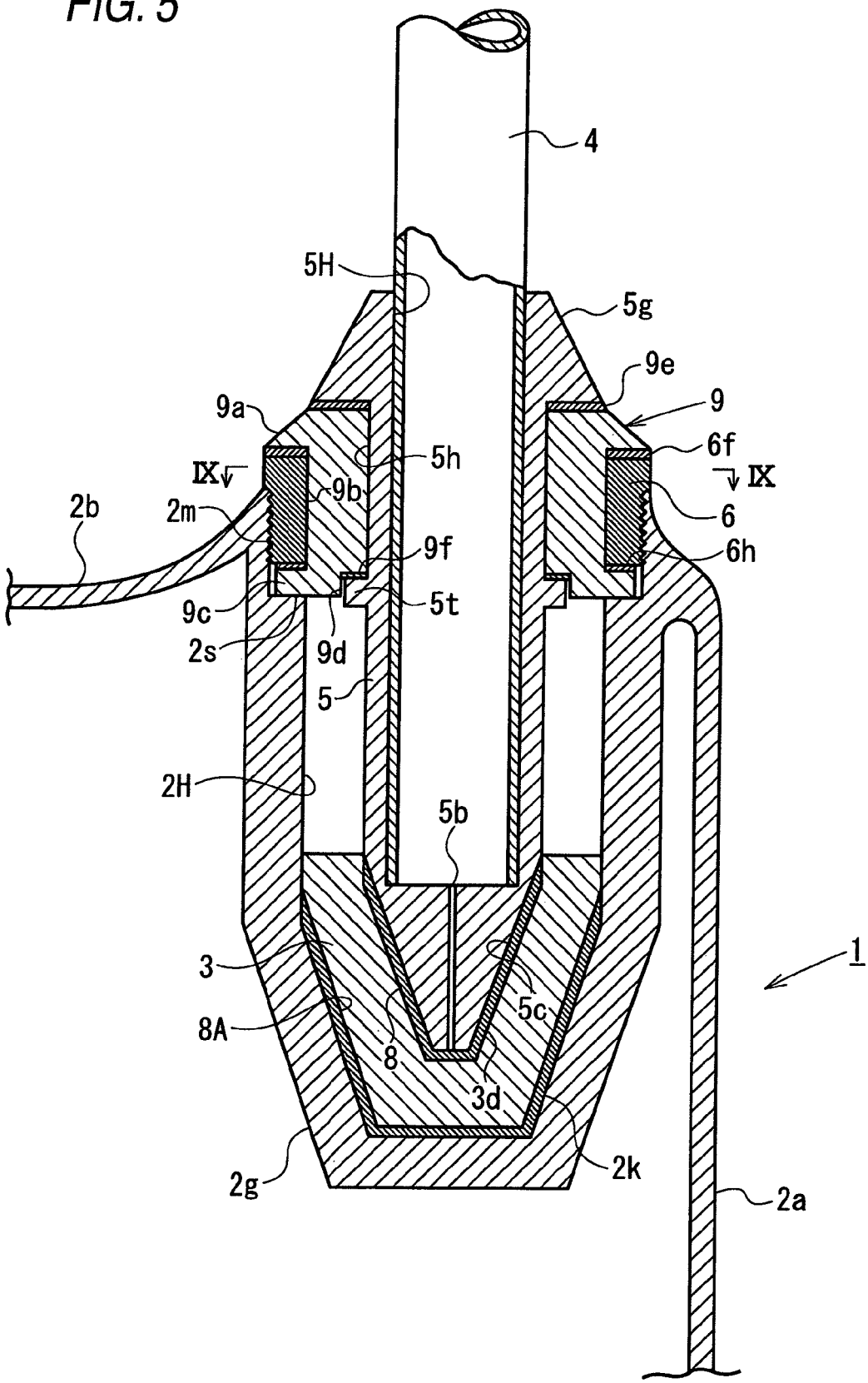
FIG. 5 is a section view taken along the V-V arrow line shown in FIG. 1.
Figure 6:
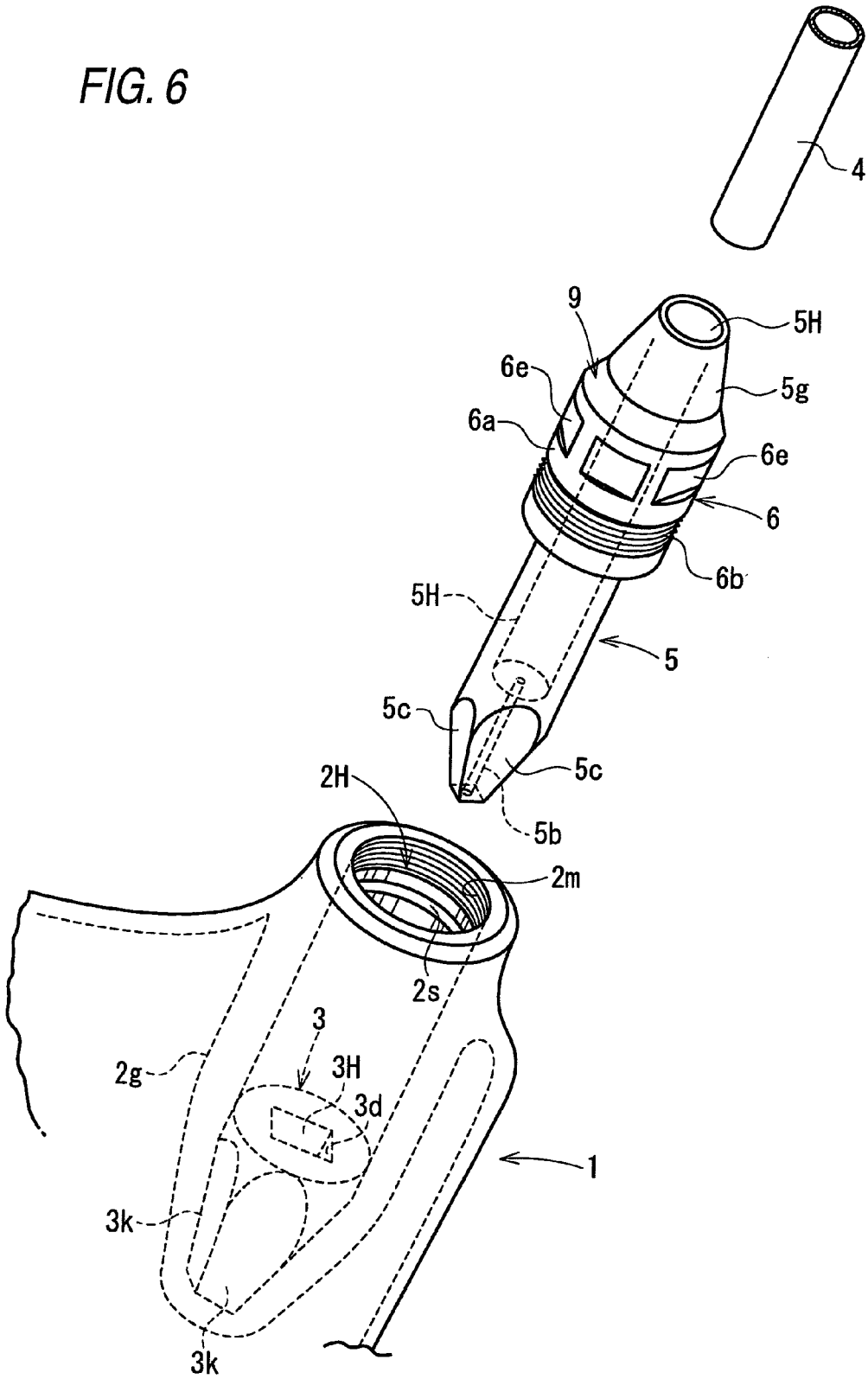
FIG. 6 is a perspective view of the hosel, shaft case and screw member.

Now, description will be given below of an embodiment according to the invention with reference to the accompanying drawings. Specifically, FIG. 1 is a front view of a golf club head according to the embodiment of the invention. FIGS. 2 and 3 are respectively side views of the golf club head in which an old hosel shown in FIG. 1 is replaced and a new hosel is mounted again. FIGS. 4A and 4B are front views of the golf club head in which the hosel shown in FIG. 1 is replaced and a new hosel is mounted again. FIG. 5 is a section view taken along the V-V arrow line shown in FIG. 1. FIG. 6 is a perspective view of the hosel, shaft case, screw member and the leading end portion of the shaft.

Firstly, description will be given below of a golf club using a hosel 3 with reference to FIGS. 1, 5 and 6.

The present golf club is structured such that a shaft case 5 having a shaft 4 is mounted on a head 1 through the hosel 3, ring holder 9 and screw member 6.

This head 1, which is of a hollow wood type, includes a face portion 2*a*, a crown portion 2*b*, a sole portion 2*c*, a toe portion 2*d*, a heel portion 2*e* and a back portion 2*f*.

As shown in FIG. 5, in such portion of the crown portion 2*b* as exists on the face portion 2*a* side and heel portion 2*e* side, there is formed a cylindrical hosel installation portion 2*g* having a hosel insertion hole 2H. The hosel installation portion 2*g* includes an open upper end and a cylindrical closed lower end, while the hosel installation portion 2*g* extends in the insertion direction of the shaft 4. In such inner peripheral surface of the hosel insertion hole 2H as exists on the entrance side thereof, there is formed a female screw 2*m*. In such portion of the hosel insertion hole 2H as exists on the slightly deeper side of the female screw 2*m*, there is formed a step surface 2*s* which extends in the decreasing diameter direction of the hosel insertion hole 2H. In such portion of the hosel insertion hole 2H as exists on the deeper side of the step surface 2*s*, there is formed a cylindrical surface which continues with the step surface 2*s*.

Such inner peripheral surface of the hosel insertion hole 2H as exists deeper than the cylindrical surface thereof is formed to have a regular square pyramid shape the diameter of which decreases toward the deeper side (lower end side) thereof; and, in this inner peripheral surface, there are formed four inclined surfaces 2*k* (FIG. 5) which obliquely cross the axis of the hosel 3. The two mutually opposed inclined surfaces 2*k* may preferably have a crossing angle (nipping angle) of about 10 to 30°, more preferably, about 15 to 20°.

The hosel 3 is inserted into and disposed in the deep portion of the hosel insertion hole 2H. The hosel 3 can be inserted into and removed from the hosel insertion hole 2H.

Figure 11:
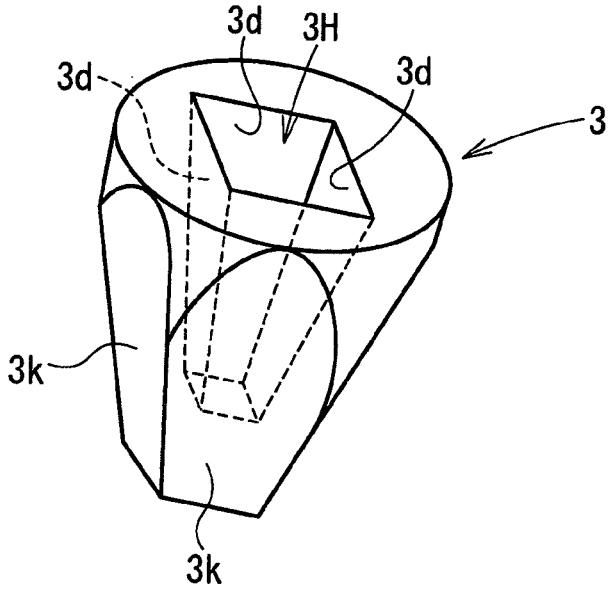
FIG. 11 is a perspective view of the hosel.

As shown in FIGS. 5, 6 and 11, the outer surface of the hosel 3 has a regular square pyramid shape (exactly, a truncated regular square pyramid shape) the diameter of which decreases toward the deeper side (lower end side) thereof, in which there are formed four inclined surfaces 3*k*. The four inclined surfaces 3*k* are disposed symmetrically with the axis of the hosel 3 between them. The mutually opposed inclined surfaces 3*k* and 3*k* has the same crossing angle as the crossing angle of the deepest portion inclined surfaces 2*k* and 2*k* of the hosel insertion hole 2H. An elastic member 8A is interposed between the inclined surface 3*k* of the hosel 3 and the inclined surface 2*k* of the hosel insertion hole 2H, thereby preventing the hosel 3 from being shaken with respect to the hosel insertion hole 2H.

Although, in the present embodiment, the outer peripheral surface of the lower portion of the hosel 3 has a regular square pyramid shape, it may also have a regular polygonal pyramid shape such as a regular triangular pyramid shape, a regular hexagonal pyramid shape, or a regular octagonal pyramid shape. Further, it may be V-shaped structure.

In the hosel 3, there is formed a shaft case insertion hole 3H which extends downwardly from the upper end face of the hosel 3. The shaft case insertion hole 3H has a regular square pyramid shape the diameter of which decreases toward the deep side thereof. Also, the shaft case insertion hole 3H includes four inclined surfaces 3*d* (FIG. 11) which respectively cross the axis of the hosel 3 obliquely. The mutually opposed inclined surfaces 3*d* and 3*d* may preferably have a crossing angle (biting angle) of about 10 to 30°, more preferably, about 15 to 20°.

The shaft case 5 is a cylindrical member and includes a shaft insertion hole 5H which extends in the axial direction of the shaft case 5 from the upper end thereof toward the lower end thereof and into which the shaft 4 can be inserted. The outer peripheral surface of the shaft case 5 has a cylindrical shape except for the upper end portion, lower portion and projecting portion 5*t* thereof. The inner peripheral surface of the shaft insertion hole 5H also has a cylindrical shape except for the lower portion thereof.

The outside diameter of the shaft case 5 may preferably be about 12 to 20 mm, more preferably, about 13 to 15 mm; and, the inside diameter of the shaft insertion hole 5H may preferably be about 8 to 10 mm, more preferably, about 8.5 to 9.5 mm. The outside diameter of the hosel 3 may preferably be about 13 to 20 mm, more preferably, about 15 to 19 mm.

In the shaft case 5, there is formed a small hole 5*b* for air bleeding which extends from the deep bottom surface of the shaft insertion hole 5H to the lower end face of the shaft case 5. The leading end of the shaft 4 is previously inserted into the shaft insertion hole 5H and is fixed together using an adhesive agent; and, the shaft 4 and shaft case 5 are previously connected together as an integral body to thereby provide a shaft case/shaft connected unit. Preferably, the adhesive agent may be applied to the outer peripheral surface of the leading end portion of the shaft 4 and the shaft 4 may be inserted down to the deep-most portion of the shaft insertion hole 5H. As the adhesive agent, preferably, there may be used an epoxy-system adhesive agent or the like. Since the small hole 5*b* is formed in the shaft case 5, when the shaft 4 is inserted into the shaft insertion hole 5H, the air is allowed to flow out through the small hole 5*b*.

On the outer peripheral surface of the intermediate portion of the shaft case 5 in the axial direction (longitudinal direction) thereof, there is provided the projecting portion 5*t*. According to the present embodiment, the projecting portion 5*t* is formed like a flange which extends round the shaft case 5.

As clearly shown in FIG. 6, the outer surface of the lower end portion of the shaft case 5 has a regular square pyramid shape (exactly, a truncated regular square pyramid shape) the diameter of which decreases toward the lower end thereof; and, it includes four inclined surfaces 5*c*. The inclined surfaces 5*c* are formed symmetrically with the axis of the shaft case 5 between them. The mutually opposed inclined surfaces 5*c* and 5*c* has a crossing angle between them, while the crossing angle is the same as the crossing angle between the inclined surfaces 3*d* and 3*d* of the hosel 3. The size of the inclined surface 5*c* of the shaft case 5 may set equal to that of the inclined surface 3*d* of the hosel 3, or when an elastic member is interposed between the inclined surfaces 5*c* and 3*d*, it may be set slightly smaller. Here, the lower end portion of the shaft case 5 and shaft case insertion hole 3H may also have a V-like shape including two inclined surfaces like a minus driver or other shapes having a non-circular section.

On the upper end portion of the shaft case 5, there is provided integrally therewith an increasing diameter portion 5*g* which includes a taper-shaped outer peripheral surface and decreases in diameter as it goes upwardly. The increasing diameter portion 5*g* has a circular truncated cone shape and includes a shaft insertion hole 5H formed in the upper portion thereof. Here, although not shown, the inner peripheral edge of the upper end side of the shaft insertion hole 5H may also be chamfered at an angle of about 20 to 45° in order to facilitate the insertion of the shaft 4.

On the small diameter portion 5*h* (FIG. 5) between the increasing diameter portion 5*g* and projecting portion 5*t* of the shaft case 5, there is mounted a ring holder 9. The ring holder 9 is a substantially ring-shaped member which includes an increasing diameter portion 9*a* formed in the upper-most portion thereof and an outwardly facing flange-shaped projecting portion 9*c* formed downwardly by a given distance of the increasing diameter portion 9*a*. The increasing diameter portion 9*a* and projecting portion 9*c* respectively extend around the ring holder 9. The outer peripheral surface of the increasing diameter portion 9*a* provides a taper shape the diameter of which decreases as it goes upwardly. On the inner peripheral edge portion of the lower end of the ring holder 9, there is provided a step portion 9*d* which extends around the ring holder 9 and with which the projecting portion 5*t* can be engaged.

Between the upper end face of the ring holder 9 and the increasing diameter portion 5*g* as well as between the downwardly facing surface of the step portion 9*d* and projecting portion 5*t*, there are interposed spacers 9*f* respectively.

A screw member 6 is rotatably fitted with the outer surface of the cylindrical small diameter portion 9*b* of the ring holder 9 that intervenes between the increasing diameter portion 9*a* and projecting portion 9*c*. The upper end face of the screw member 6 is contacted through a spacer 6*f* with the increasing diameter portion 9*a*, while the lower end face thereof is contacted through a spacer 6*h* with the projecting portion 9*c*.

As clearly shown in FIG. 6, the screw member 6 has a substantially ring shape and, in the outer peripheral surface of the lower half portion of the screw member 6, there is formed a male screw 6*b*. In the outer peripheral surface of the upper portion 6*a*, there are formed multiple recessed portions 6*e* which respectively provide nut-like portions. In operation, with a tool engaged with one or more of the recessed portions, the screw member 6 can be turned.

Figure 12A:
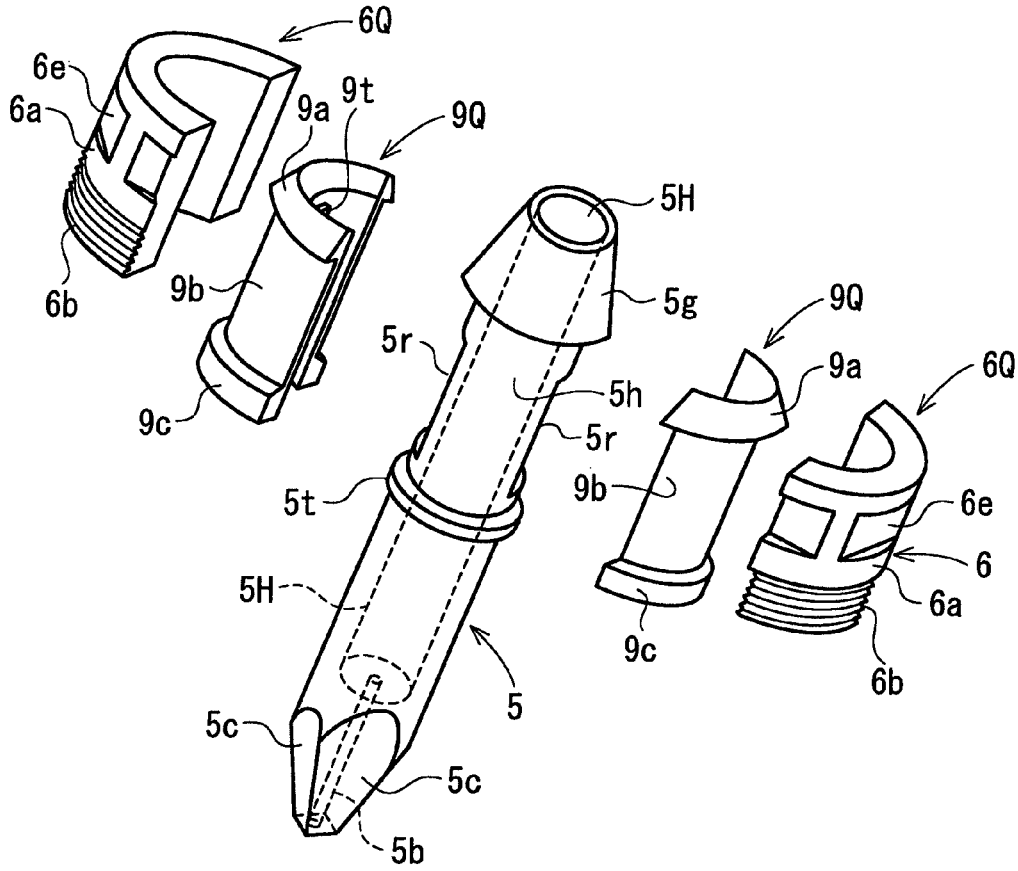
FIG. 12A is an exploded perspective view of a shaft case, a ring holder and a screw, showing how the ring holder and screw are assembled to the shaft case.
Figure 12B:
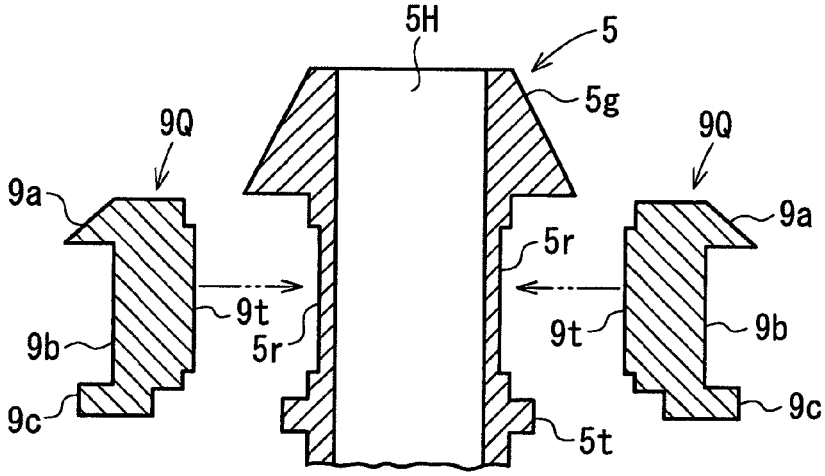
FIG. 12B is a section view of the shaft case and ring holder, showing the engagement relationship between them.

Here, the ring holder 9 and screw member 6, actually, as shown in FIGS. 12A and 12B, are respectively a combination of two half members 9Q and a combination of two half members 6Q obtained when their combined or completed bodies are respectively divided in two along their respective axes. On the inner peripheral surface of the ring holder half member 9Q, there is provided a projecting portion 9*t*; in the outer peripheral surface of the small diameter portion 5*h* of the shaft case 5, there is formed a recessed portion 5*r*; and, when the projecting portion 9*t* and recessed portion 5*r* are engaged with each other, the ring holder 9 is prevented against rotation. Alternatively, such projecting portion may also be provided on the shaft case 5 and such recessed portion may also be formed in the ring holder half member 9Q.

To assemble the golf club, as shown in FIG. 6, firstly, the hosel 3 is inserted into the hosel insertion hole 2H, and the inclined surfaces 3*k* and 2*k* are contacted with each other through the elastic member 8A.

The shaft case 5 of the shaft case/shaft connected unit, in which the shaft case 5 is fixed to the leading end of the shaft 4, is inserted into the shaft case insertion hole 3H. Here, in the present embodiment, the thin-piece-shaped elastic member 8 such as a thin rubber member (for example, a thin rubber piece or a thin elastomer having a thickness of about 0.5 to 5 mm) has been previously mounted on the inclined surface 5*c* of the shaft case 5 and the leading end face of the shaft case 5 by daubing, by pasting or by similar means. The elastic member 8 may also have been previously mounted on the shaft case 5 or may also be mounted onto the shaft case 5 after the shaft case/shaft connected unit is formed.

The leading end side of the shaft case 5 of the shaft case/shaft connected unit is inserted into the shaft case insertion hole 3H in such a manner that the inclined surface 5 and 3*d* are superimposed on top of each other and, after then, the male screw 6*b* of the screw member 6 is threadedly engaged into the female screw 2*a* in the upper inner peripheral surface of the hosel insertion hole 2H.

Thus, as shown in FIG. 5, the lower end face of the screw member 6 presses the projecting portion 9*c* of the ring holder 9 against the step surface 2*s* to thereby fix the ring holder 9; the ring holder 9 is pressed against the projecting portion 5*t* of the shaft case 5; and thus, the inclined surface 5*c* of the shaft case 5 is pressed against the inclined surface 3*d* of the hosel 3 through the elastic member 8, thereby fixing the shaft case 5. This completes a golf club in which the shaft 4 and head 1 are formed as an integral body, because the shaft case 5 and shaft 4 are strongly bonded to each other with the adhesive agent.

Here, in FIGS. 1, 5, 6 and 9, the shaft 4 is disposed coaxially with the axis of the hosel insertion hole 2H. As shown in FIGS. 2 to 4, 7, 8 and 10 which will be respectively discussed later, the position and inclining direction of the shaft 4 can be changed.

Figure 7:
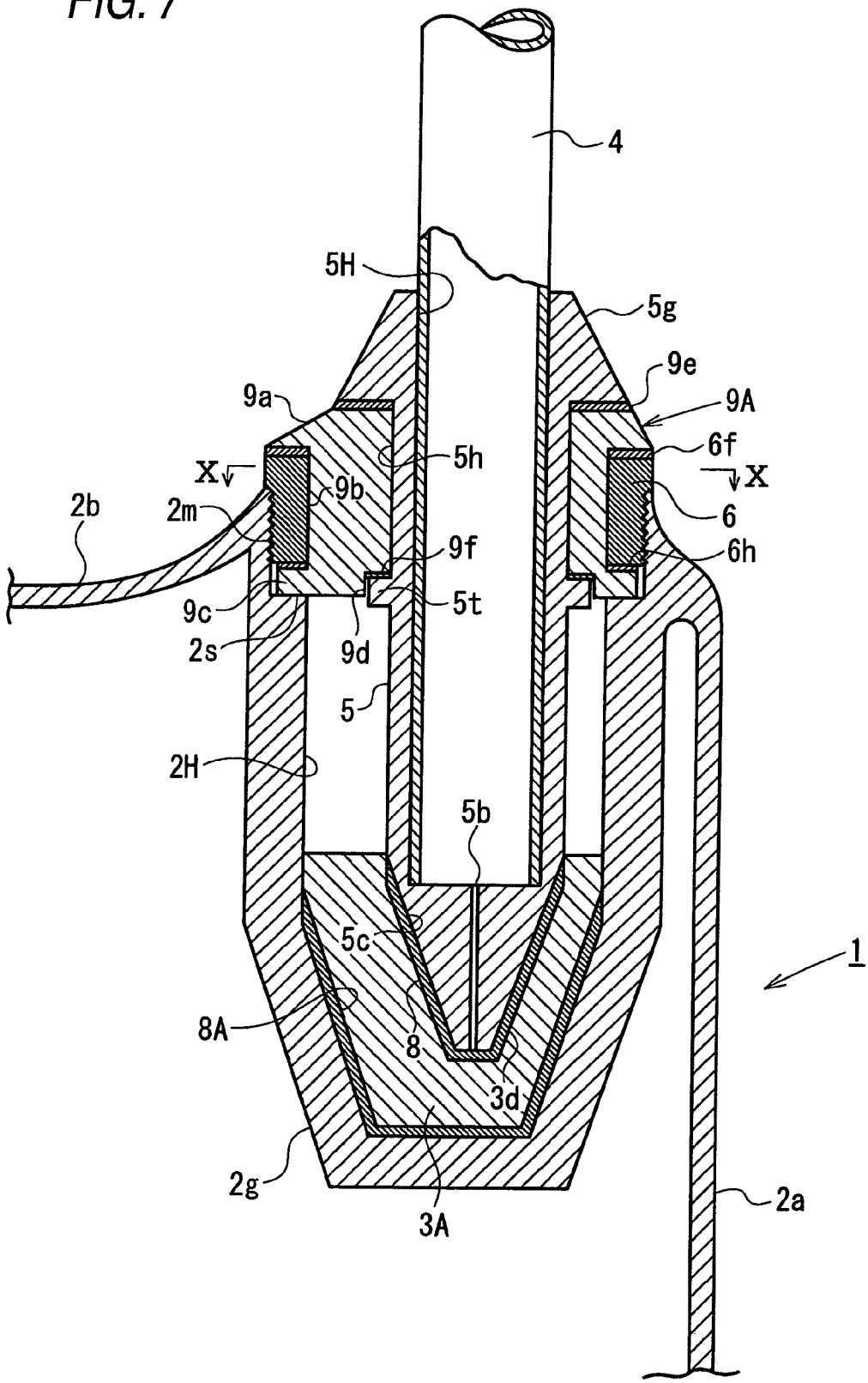
FIG. 7 is a section view of the hosel portion of the golf club head shown in FIG. 2.
Figure 8:
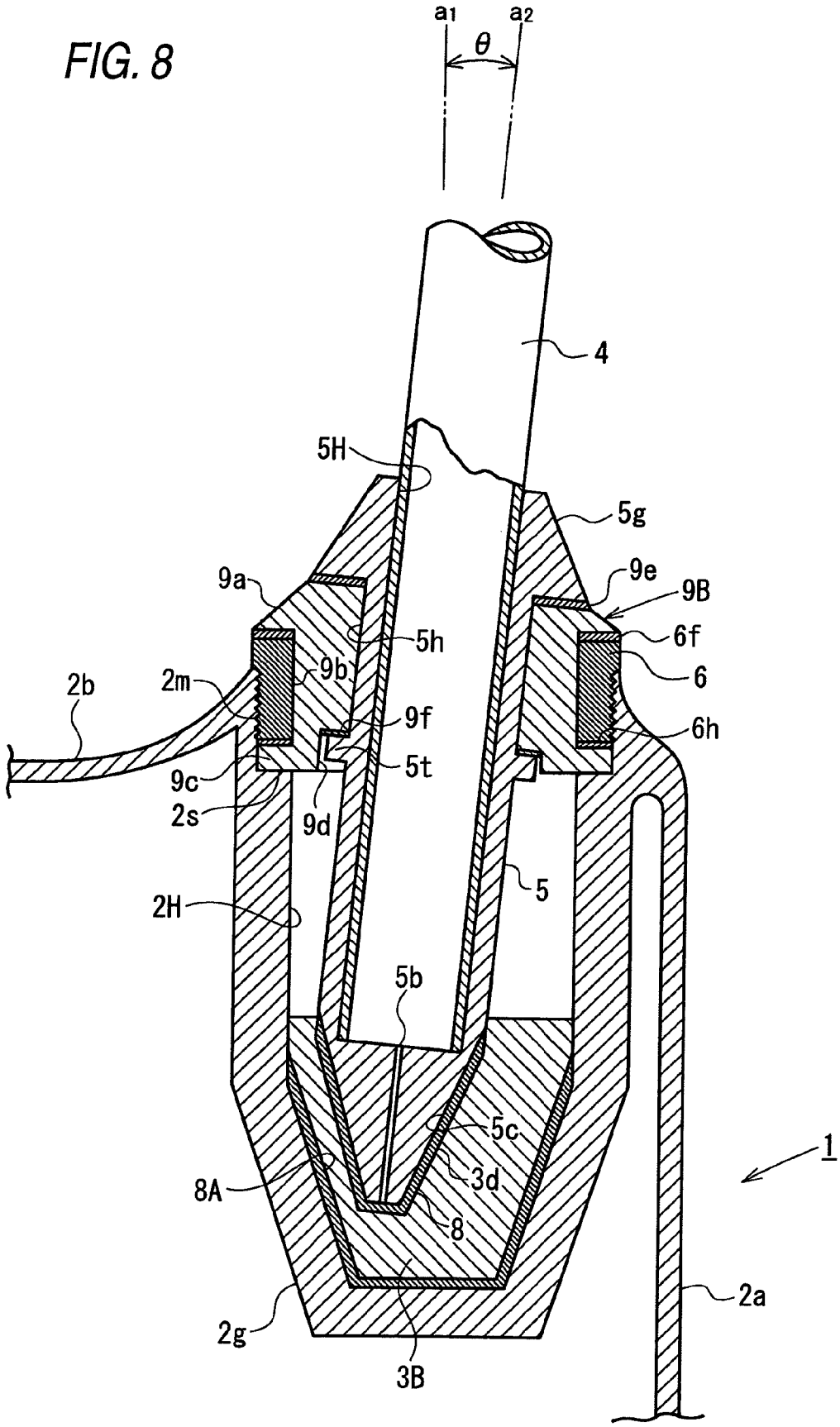
FIG. 8 is a section view of the hosel portion of the golf club head shown in FIG. 3.
Figure 9:
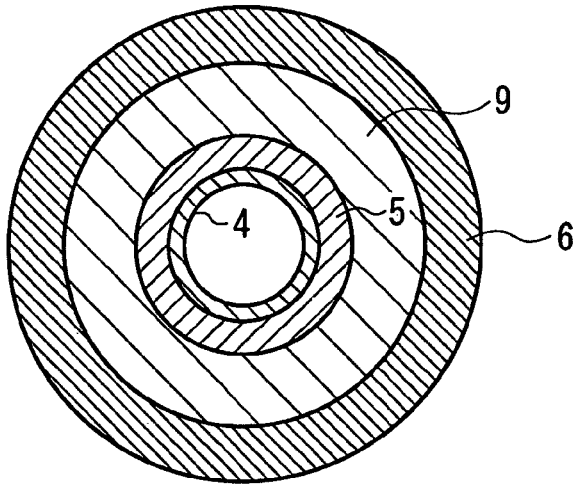
FIG. 9 is a section view taken along the IX-IX arrow line shown in FIG. 5.

According to the present embodiment, the hosel 3 and ring holder 9 can be respectively replaced with other hosel and ring holder in which a shaft case insertion hole or a shaft insertion hole is formed eccentric or is inclined. FIGS. 7 and 8 respectively show examples of such replacing hosel and ring holder.

Figure 10:
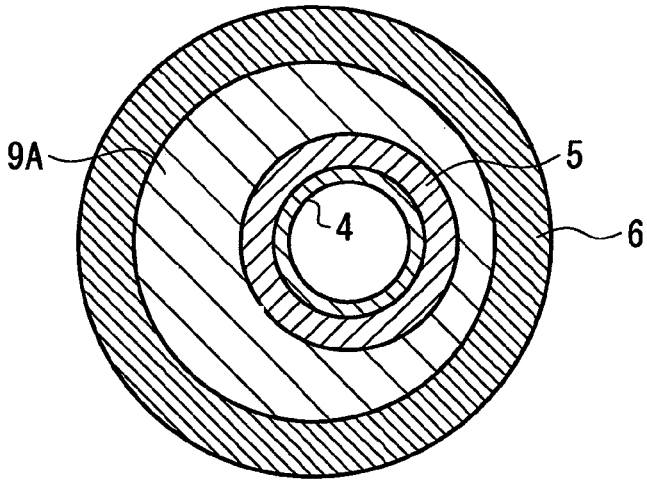
FIG. 10 is a section view taken along the IX-IX arrow line shown in FIG. 7.

In FIGS. 2, 7 and 10, there are shown a hosel 3A structured such that a shaft case insertion hole 3H is shifted from (is set eccentric to) the axial position of the hosel 3A, and a ring holder 9A is structured such that a shaft insertion hole 5H is formed eccentric to the axial position of the outer peripheral surface of the ring holder 9A. The axes of the shaft case insertion hole 3H and shaft insertion hole 5H are respectively formed parallel to and slightly (for example, 0.5 to 4 mm) spaced from the axes of the outer peripheral surface of the small diameter portion 9*b* of the ring holder 9A and hosel insertion hole 2H.

A hosel 3B and a ring holder 9B shown in FIGS. 3, 4 and 8 are respectively structured such that the axial directions of the shaft case insertion hole 3H and shaft case insertion hole 5H are respectively inclined with respect to the axial directions of the hosel 3B and the outer peripheral surface of the small diameter portion 9*b* of the ring holder 9B.

According to this modification, the axial line $a_2$ of the shaft case insertion hole 3H and shaft insertion hole 5H obliquely crosses the axes of the hosel insertion hole 2H and the outer peripheral surface of the small diameter 9*b* of the ring holder 9B as well as the axial line $a_1$ of the outer peripheral surface of the hosel 3B. A crossing angle θ (FIG. 8) between the axial lines $a_1$ and $a_2$ may preferably be approximately 0.1 to 5.0°, more preferably, approximately 0.25 to 3.0°.

Here, the axial lines $a_1$ and $a_2$ may not cross each other but may be twisted with respect to each other. That is, the axial lines $a_1$ and $a_2$ may not cross each other but the axial line $a_2$ may pass by the neighborhood of the axial line $a_1$. In this case, for the angles of the axial lines $a_1$ and $a_2$, the axial line $a_2$ may be inclined most toward the heel side of the golf club head, there may be assumed a surface which contains the axial line $a_1$ and extends in the ball flying direction, and a crossing angle between such surface and the axial line $a_2$ may be set in the range of the above angle θ.

To remove the shaft case 5 from the golf club, the screw member 6 may be turned in its loosening direction. Since the male screw 6*b* of the screw member 6 is threadedly engaged with the female screw 2*m* of the hosel insertion hole 2H, when the screw member 6 is turned in its loosening direction, the screw member 6 is moved upwardly (is threadedly moved); and thus, the screw member 6 pushes up the increasing diameter portion 5*g* to thereby move the shaft case 5 upwardly. By removing the screw member 6 from the female screw 2*m*, the shaft case 5 can be pulled out. For the hosel 3, 3A or 3B, a proper tool may be inserted into the hosel insertion hole 2H and the hosel may be taken out of the hosel insertion hole 2H using the tool. As this tool, preferably, there may be used a tool which includes a chuck mechanism such as a vacuum chuck.

When the hosel 3 and ring holder 9 are replaced with the hosel 3A and ring holder 9A shown in FIG. 7 or the hosel 3B and ring holder 9B shown in FIG. 8, the goose and lie angle of the shaft can be adjusted.

When there are used the hosel 3A and ring holder 9A in which the shaft case insertion hole 3H is set eccentric, as shown in FIG. 7, the shaft 4 can be set nearer to the face side of the club by an amount equivalent to such eccentric distance. A side view of the substantial whole of the golf club shown in FIG. 7 is shown FIG. 2.

When the hosel 3A and ring holder 9A are removed from the hosel insertion hole 2H once from their states shown in FIGS. 2 and 7 and are then turned by 90°, 180°, or 270°, the position of the shaft 4 can be changed to the back side or toe side in a parallel translation manner. In FIG. 2, the goose is smallest and, in a state where the hosel 3A and ring holder 9A are turned 180° from the state shown in FIG. 2, the goose is largest. When the position of the shaft 4 is set on the toe side or heel side, the distance between the axis of the shaft 4 to the center of gravity of the head is changed.

As shown in FIGS. 3, 4A, 4B and 8, since there are used the hosel 3B and ring holder 9B in which the shaft case insertion hole 3H and shaft insertion hole 5H are set to be oblique with respect to the axis of the hosel insertion hole 4, the inclination of the shaft 4 can be made different from those shown in FIGS. 1 and 5 (for example, FIGS. 3, 4A and 4B).

In FIG. 3, the axis $a_2$ of the shaft 4 is inclined by an angle θ with respect to the axis $a_1$ of the hosel insertion hole 2H. Therefore, when the hosel 3B is turned by 90°, 180°, or 270°, the inclination of the shaft 4 can be changed. In FIG. 4A, the shaft 4 is inclined most to the heel side. In FIG. 4B, the shaft 4 is inclined most to the toe side. In FIG. 3, the shaft 4 is inclined most to the face side.

In this manner, by changing the direction of the inclination of the shaft 4, the lie angle and slice angle can be changed.

Referring to the lie angle, it is smallest in FIG. 4A and it is largest in FIG. 4B, providing an up lie.

Referring to the slice angle, in FIG. 3 where the shaft 4 is inclined most to the face side, there is provided a hook face where the face surface is closed most. On the other hand, when the shaft 4 is inclined most backwardly (not shown), there is provided a slice face where the face surface is opened most.

In this manner, by using the hosel 3B and ring holder 9B, the inclination direction of the shaft 4 with respect to the head 1 can be changed, thereby being able to change the lie angle and slice angle.

In this golf club, the increasing diameter portion 5*g* is formed to have a taper shape; however, there may also be formed a flat flange-shaped increasing diameter portion and a ferrule may be mounted on such increasing diameter portion.

In this embodiment, the screw member 6 is fitted with the outer surface of the ring holder 9 and, when the screw member 6 is turned, it will not be contacted with the shaft 4. This can prevent the shaft 4 against damage.

Here, since between the hosel 3, 3A, or 3B and hosel insertion hole 2H as well as the shaft case 5 and shaft case insertion hole 3H, there is interposed the thin piece-shaped elastic member 8A or 8 made of rubber, elastomer or synthetic resin, impacts and vibrations generated at the impact time can be absorbed.

In this embodiment, the inner surfaces on the hole deep side of the hosel insertion hole 2H and shaft case insertion hole 3H as well as the outer surfaces of the lower end side of the hosel 3, 3A, 3B and shaft case 5 are respectively formed as the inclined surfaces respectively having a regular square pyramid shape, and these inclines surfaces are engaged with each other. This can reduce the shaking motion of the shaft 4 and also the shaft 4 can be prevented against rotation around the axis thereof. That is, the shaft 4 can provide high fixation rigidity in the torque direction thereof.

Also, since four inclined surfaces are provided and the leading end portions of the hosel 3, 3A or 3B and shaft case 5 are formed tapered, they can be easily inserted into the hosel insertion hole 2H and shaft case insertion hole 3H.

Here, the hosel 3, 3A or 3B is a short and light member which is disposed only in the deep portion of the hosel insertion hole 2H.

According to the invention, the shaft of the golf club can be replaced easily. To replace the shaft, a shaft case of the same type as the shaft case 5 is previously fixed to a new shaft to be replaced using an adhesive agent. Here, the ring holder 9 and screw member 6 are also previously mounted on this shaft case.

The screw member 6 of an existing golf club is turned and the old shaft 4 is removed from the head 1 together with the old shaft case 5 and screw member 6. Next, a new shaft with a shaft case and screw member mounted thereon (a shaft case/shaft connected unit) is inserted into the shaft case insertion hole 3H and the screw member 6 is screwed into the female screw 3*a* to thereby fix the shaft case to the golf club. Here, since there is used only the single screw member 6, the shaft mounting and removing operation can be executed easily.

In this manner, the mounting and replacement of the shaft can be carried out very simply and quickly. Here, conventionally, to replace a shaft, the hosel portion of an existing golf club is heated to destroy the structure of the hardened matter of the adhesive agent and, after removal of an old shaft, a new shaft is fixed using an adhesive agent; and, therefore, it takes several hours to about one day to replace the shaft. On the other hand, according to the above embodiment of the invention, since the shaft case 5 is previously mounted on a new shaft with an adhesive agent, the shaft can be replaced in several minutes or so. Therefore, it is possible to realize a system in which shafts of several specifications each having a shaft case mounted thereon are previously prepared and thus a user can try to hit a ball using the golf club while mounting the different shafts onto the same head main body sequentially.

Here, as the hosel 3B and ring holder 9B, there may also be previously produced hosels and ring holders in which the shaft case insertion holes 3H and shaft insertion holes 5H have various kinds of inclination angles θ. For example, as replacing hosels, when there have been previously prepared multiple kinds of hosel groups the above angle θ of which is gradually varied like 0.5°, 1°, 1.5°, 2°, 2.5° and 3°, the above trial hitting can be carried out in such a manner that the lie angle and slice angle are changed gradually.

The above-mentioned hosel, shaft case and screw member may be preferably made of metal and, more preferably, they may be made of aluminum or titanium or an alloy thereof. The hosel 3, 3A, 3B and ring holder 9, 9A, 9B may be preferably made of material having a specific gravity equal to or lower than the head main body; and, specifically, for example, there may be used a titanium alloy, aluminum, an aluminum alloy, a magnesium alloy, FRP or synthetic resin. Further, there may be used a material treated by an alumite treatment.

The material of the head is not limited to any specific one. However, in a wood type golf club, it can be made of, for example, a titanium alloy, an aluminum alloy or stainless steel.

According to the above embodiment, in the hosel and hosel insertion hole, there are formed four inclined surfaces which can provide a regular square pyramid shape. However, there may also be provided a regular polygonal square shape in which the number of inclined surfaces is three or five or more. Also, the leading end portion of the hosel and the deep portion of the hosel insertion hole may also be formed to have a section of a recessed polygonal shape such as a star shape, or a section of a gear teeth shape.

Here, as a grip to be mounted on the shaft 4, in some cases, there is used a grip the section of which is formed not a complete circle. For example, of the outer peripheral surface of the grip, the lower side surface directed to the ground when the golf club is positioned for hitting a ball is expanded from the other remaining surfaces of the grip. In this case, however, there is a fear that, when the direction of the hosel 3A or 3B is changed, the grip expanded portion cannot provide the ground side. In view of this, according to the invention, there may be preferably used a grip the section of which has a complete circle.

Although, in the above embodiment, the golf club head is of a wood type, the invention can also be applied to golf club heads of any types including a utility type, an iron type, a patter type and the like.

Here, in the golf club head shown in the drawings, due to provision of the hosel 3, 3A, 3B, hosel installation portion 2g, shaft case 5 and screw member 6, the weight thereof on the heel side is greater than an ordinary golf club head. In view of this, by increasing the thickness of the toe side or back portion thereof or by providing a weight on the toe side thereof, the golf club head may be balanced.

What is claimed is:

1. A golf club head, formed with a hosel insertion hole for mounting a leading end of a shaft, the golf club head comprising:

a female screw, formed in an inner peripheral surface of the entrance portion of the hosel insertion hole;

a hosel, formed with a shaft case insertion hole and mounted removably on a deep portion of the hosel insertion hole;

a shaft case, formed with a shaft insertion hole, a leading end portion of the shaft case being removably mounted into the shaft case insertion hole;

a ring holder, fitted with an outer surface of the shaft case and unmovable in an axial direction thereof;

a screw member, fitted with an outer surface of the ring holder rotatably in a peripheral direction of the ring holder and unmovable in an axial direction thereof; and a male screw, formed on an outer peripheral surface of the screw member so that the screw member is threadedly engaged with the female screw.

2. A golf club, comprising:

a head, formed with a hosel insertion hole, including:

a female screw, formed in an inner peripheral surface of the entrance portion of the hosel insertion hole;

a hosel, formed with a shaft case insertion hole and mounted removably on a deep portion of the hosel insertion hole;

a shaft case, formed with a shaft insertion hole, a leading end portion of the shaft case being removably mounted into the shaft case insertion hole;

a ring holder, fitted with an outer surface of the shaft case and unmovable in an axial direction thereof;

a screw member, fitted with an outer surface of the ring holder rotatably in a peripheral direction of the ring holder and unmovable in an axial direction thereof; and a male screw, formed on an outer peripheral surface of the screw member so that the screw member is threadedly engaged with the female screw; and a shaft, inserted into the shaft insertion hole of the head.

3. The golf club according to claim 2, wherein the shaft is concentric with the shaft case insertion hole.

4. The golf club according to claim 2, wherein the shaft is concentric with the hosel insertion hole.

5. The golf club according to claim 2, wherein an axis of the shaft is inclined with respect to an axis of the hosel insertion hole.

6. The golf club according to claim 2, wherein an axis of the shaft is parallel to an axis of the hosel insertion hole and is separated from the axis of the hosel insertion hole.

7. The golf club according to claim 2, wherein the shaft is fixed to the shaft insertion hole with an adhesive agent.

8. The golf club according to claim 2, wherein, a lower end portion of the hosel has a polygonal-shaped section, and the deep portion of the hosel insertion hole has a section adapted to engage with the lower end portion of the hosel.

9. The golf club according to claim 8, further comprising an elastic member, interposed between the lower end portion of the hosel and an inner surface of the deep portion of the hosel insertion hole.

10. A method for adjusting a property of the golf club according to claim 2, comprising:

separating the hosel from the hosel insertion hole and shaft case;

replacing the hosel and the ring holder with other hosel and ring holder structured such that the position or angle of the shaft case insertion hole is different; and fixing the shaft case to the hosel insertion hole by the screw member.

11. A method for adjusting a property of the golf club fixing to claim 2, comprising:

fixing a new shaft to a new shaft case to form a connected unit;

removing the shaft case and the shaft from the head; and mounting the connected unit onto the head.

12. The golf club according to claim 2, wherein:

an axis of the shaft is inclined with respect to an axis of the hosel; and the axis of the shaft intersects with the axis of the hosel at an inside of the hosel.

13. The golf club according to claim 2, wherein:

an axis of the shaft is inclined with respect to an axis of the hosel; and the axis of the shaft intersects with the axis of the hosel at an aperture plane of the hosel.

* * * * *